United States Patent [19]

Grubb, Jr.

[11] 4,258,966

[45] Mar. 31, 1981

[54] BEARING SYSTEM AND LOCKING MECHANISM FOR ROTARY STORAGE CABINET

[75] Inventor: Frederick H. Grubb, Jr., Stuarts Draft, Va.

[73] Assignee: Acme Visible Records, Inc., Crozet, Va.

[21] Appl. No.: 949,227

[22] Filed: Oct. 6, 1978

[51] Int. Cl.[3] ..... A47B 46/00; A47B 49/00; A47F 3/10

[52] U.S. Cl. ..... 312/305; 312/125; 312/286; 312/252; 108/139; 248/349

[58] Field of Search ..... 312/125, 135, 202, 11, 312/97.1, 305, 215, 216, 217, 218, 221, 286, 252; 108/139, 142; 248/349

[56] References Cited

U.S. PATENT DOCUMENTS

| | | | |
|---|---|---|---|
| 271,054 | 1/1883 | Fowler | 108/139 |
| 678,612 | 7/1901 | Daemicke | 312/252 |
| 924,938 | 6/1909 | Richter | 108/139 |
| 1,859,352 | 5/1932 | Albee | 248/349 |
| 2,070,168 | 2/1937 | King | 312/252 |
| 2,673,778 | 3/1954 | Wood | 312/125 |
| 3,046,052 | 7/1962 | Summers | 108/139 |
| 3,172,712 | 3/1965 | Allen | 312/305 |
| 3,248,815 | 5/1966 | Arage | 312/135 |
| 3,765,738 | 10/1973 | Cobb | 312/11 |
| 3,850,487 | 11/1974 | Batchelor | 312/252 |
| 3,868,157 | 2/1975 | Robinson | 312/252 |
| 3,957,159 | 5/1976 | Radek | 312/216 |

*Primary Examiner*—Victor N. Sakran
*Attorney, Agent, or Firm*—Pennie & Edmonds

[57] ABSTRACT

This invention relates to a rotary storage cabinet comprised of an outer stationary housing and an inner rotatable rotor having four sides two of which are positionable to present the contents of the cabinet simultaneously to two opposite openings in the housing. Two other opposite sides of the rotor are positionable to close the openings in the housing. The cabinet is constructed from a plurality of sub-assemblies which are shipped for assembly at the point of use. The basic structure of the unit comprises a base (20), two pilaster frames (10), and a top frame pan (30) each of which is shipped as a sub-assembly. The cabinet includes several features including: the ball bearing mechanism (FIGS. 7-9); spring urged wheel (180) and detent (150) (FIG. 12) stop mechanism; lock mechanism (160) (FIG. 12); welded pilaster frames (10); and a single centrally located rotor frame (50). The unit is modular permitting the use of like "add-on" units (FIGS. 16 and 17).

2 Claims, 17 Drawing Figures

10
12
13
14
16
17
18
20
21
22
24
25
26
30
32
34
40
42
46
48
50
52
54
56
60
62
68
70
72
74
75
80
82
86
88
89
90
94
96
98
102
104
106
108
110
112
120
160
178
180
220
230
250
295

BEARING SYSTEM AND LOCKING MECHANISM FOR ROTARY STORAGE CABINET

BACKGROUND OF THE INVENTION

Rotary storage cabinets for storing various articles are known. Commonly such storage cabinets are provided with shelves for filing of office records. They may, however, also be used for the storage of other materials such as books, computer tapes or discs, music tapes or discs, for the display of articles for sale, clothing lockers, and numerous other items. In one such rotary storage cabinet the rotor that rotates within the outer housing has four sides any one of which may be presented to the open side of the housing. The open side of the housing may or may not have a door or doors.

In another such rotary storage cabinet it is known to provide the rotor with two sets of shelves arranged at 180° with respect to each other with the other two sides of the four sided rotor being positionable to close the opening in the housing. In this construction no door is required in the housing. This construction also lends itself to accessability from two opposite sides by providing that the housing has openings in two opposite sides. In this latter construction the rotor may be rotated to present a closure door to both openings simultaneously or, upon rotation of 90° the shelves may be presented to the two openings simultaneously. The present invention is directed to this latter type of rotary storage cabinet.

In rotary storage cabinets of the type to which the present invention is directed there are a number of problems in manufacture, shipping, sales and assembly. Among these problems is the fact that these cabinets tend to be quite large and if shipped fully assembled the transporation costs are excessive since a considerable quantity of empty space is being shipped as well. As a result such cabinets are generally shipped in knocked down form with the same being assembled either by the manufacturer's representative or by the purchaser on the premises where it is to be used. Since the assemblers in such a circumstance are generally not skilled it is necessary that the units be so designed as to be assembled readily with hand tools while at the same time insuring adequate strength and maintenance of shape through sufficient rigidity. At the same time, the less material utilized in the entire unit the more economy both with respect to raw material and labor that may be achieved in the manufacture of the product.

Often in attempting to resolve these problems it occurs that resolution or improvement of one problem results in the aggravation of another problem. The larger the parts assembled in the factory and shipped, then the simpler the assembly on site and the more certainty there is that the structure will be properly assembled, strong and stable. At the same time, however, the larger the assembly in the plant the more difficult and larger the packaging and the more costly the transportation. At the same time, as well, the cost of in plant assembly of sub-units increases the cost of the unit as compared with shipment of individual parts which are then assembled esentially without cost by the purchaser or representative.

Still further, it is desirable that the units be modular in construction in order to permit the addition of additional units integrated with the original unit or units in order to save space and in order to provide an extended line of such cabinets. Frequently such cabinets are utilized as room dividers and the modular construction lends itself well to this use while permitting individuals positioned on both sides of the room divider to have access to the files.

PRIOR ART

One currently manufactured rotary file cabinet that is available commercially is disclosed in U.S. Pat. No. 3,868,157. This patent discloses a rotary file cabinet providing access from two opposite sides of the cabinet and in which the internal rotor has four sides two of which, positioned 180° from each other, contain shelves which may be positioned in the oppositely located openings of the housing thus permitting access from either side. Upon rotating the rotor 90° the remaining two sides of the rotor are positioned in the openings to close them. The construction shown is modular, thus permitting units to be added. A snubber mechanism is provided for stopping the rotation of the rotor in a resilient manner and insuring its proper alignment in any one of its four possible positions. A pedal operated arrangement releases the engagement of the snubber when it is desired to rotate the rotor. It has been found, however, that this pedal operation has certain disadvantages. The pedal itself extends outwardly of the cabinet to one or both sides and comprises a protrusion which clerical personnel frequently find damaging to shoes and stockings and occassionally injurious to the foot. Still further, particularly in rooms containing a number of such cabinets, the clacking noise induced when the pedal is operated to release the rotor and again when the snubber engages an opening in the rotor to stop the same has been found disturbing to personnel working nearby. Still further, the snubber mechanism is comprised of numerous springs, levers, plates and the like which are expensive to manufacture and assemble and which by their complex nature require in-plant assembly.

BRIEF SUMMARY OF THE INVENTION

The present invention aims to overcome the various problems mentioned above and the disadvantages of the snubber mechanism as described above. In order to insure thoroughly adequate strength, accurate and rigid retention of shape and to simplify on site assembly the present rotary storage cabinet is constructed from a number of sub-assemblies. As described in detail below the currently preferred arrangement provides for nine different sub-assemblies three of which are duplicated thus providing for twelve sub-assemblies which by their nature pack compactly together with miscellaneous hardware thus eliminating waste or cost in transportation While the assemblies do require some in-plant assembly with attendant cost the same is minimized by this invention and, further, what in plant assembly is undertaken is largely limited to welding at important locations thus insuring great strength for light weight and the proper rectangular shape to the various sub-assemblies such as the two identical pilaster frames which provide the basic strength of the unit together with the base and top.

The rotor is assembled on a single open welded rectangular frame extending through the vertical axis of the rotor. This arrangement provides great strength and rigidity at low weight and cost.

Additionally, a greatly simplified spring urged wheel and detent arrangement is utilized instead of the complex snubber mechanism to insure proper alignment of the rotor in any one of its four selectable positions. A unique locking arrangement is also provided for in which a throw pin moves upwardly through the base when the lock is operated to engage or disengage a peripheral slot or groove in the underside of the rectangular rotor base.

Still further, a unique bearing arrangement is provided for support of the rotor which is simple and economical to produce. This bearing comprises a bearing plate to hold the ball bearings which operate on flat surfaces rather than in a track.

BRIEF DESCRIPTION OF THE DRAWINGS

The construction and operation of the device will be apparent to those skilled in the art from the following description and drawings in which.

DETAILED DESCRIPTION OF PREFERRED EMBODIMENT

Figure 3:
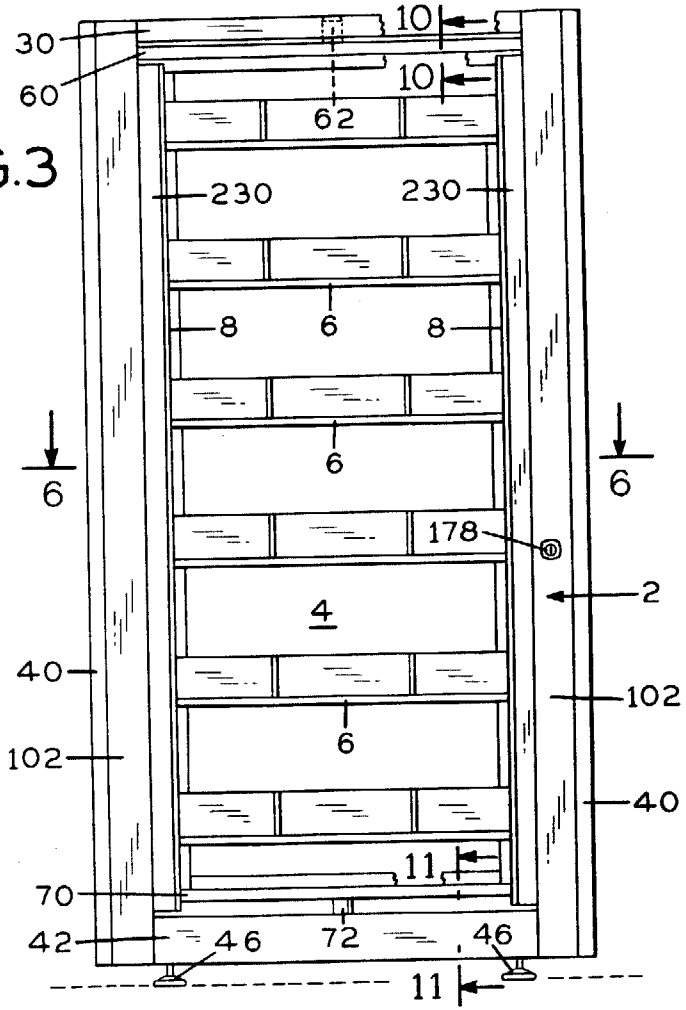
FIG. 3 is a view like FIG. 2 with the rotor shown in open position.
Figure 2:
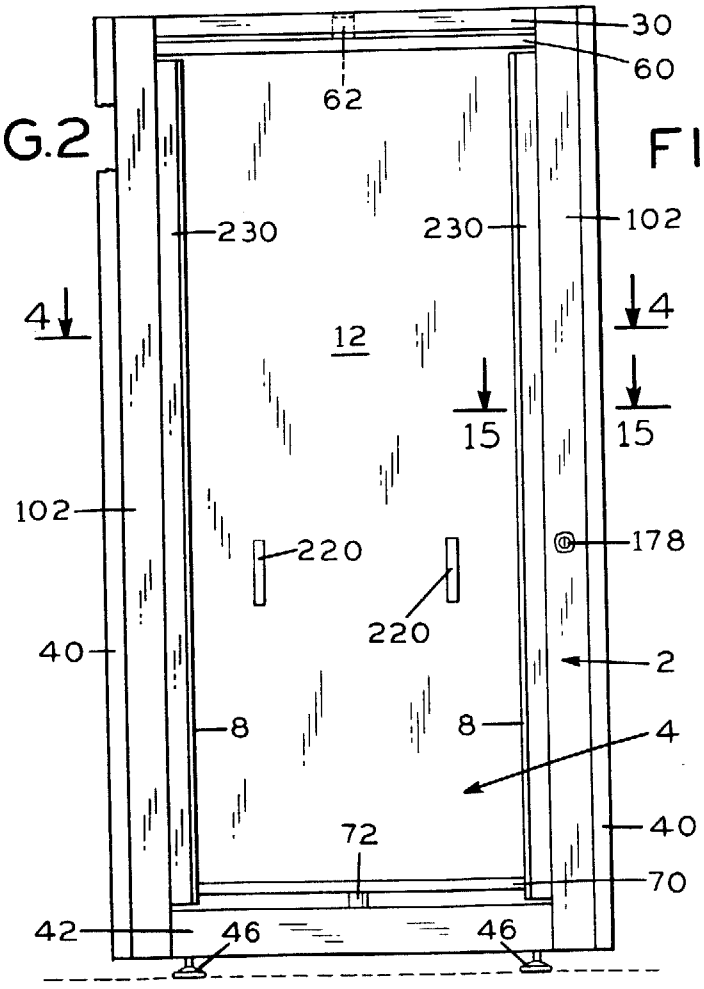
FIG. 2 is a front elevation of the assembled rotary storage cabinet showing the rotor in the closed position.
Figure 4:
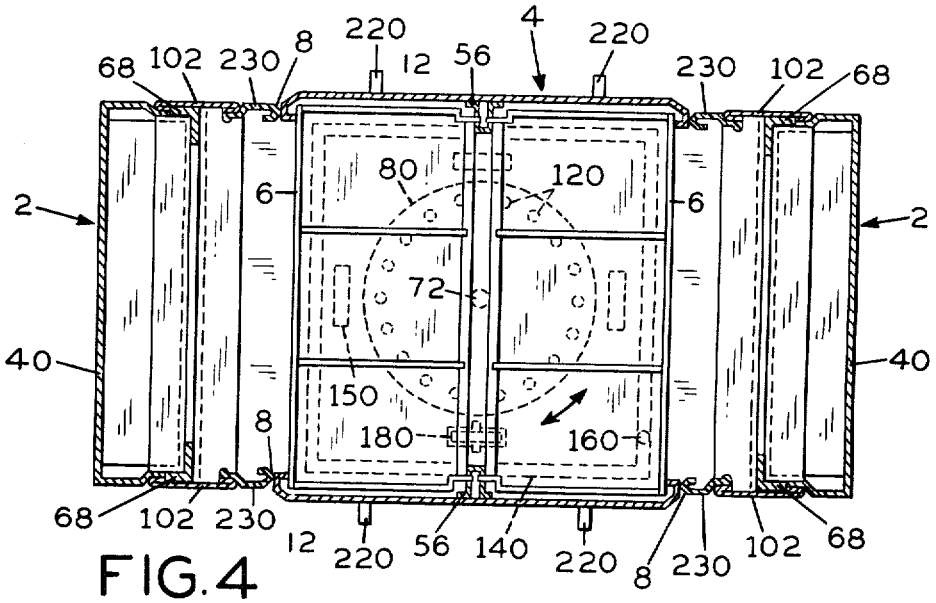
FIG. 4 is a cross-section taken along the line 4—4 of FIG. 2.
Figure 6:
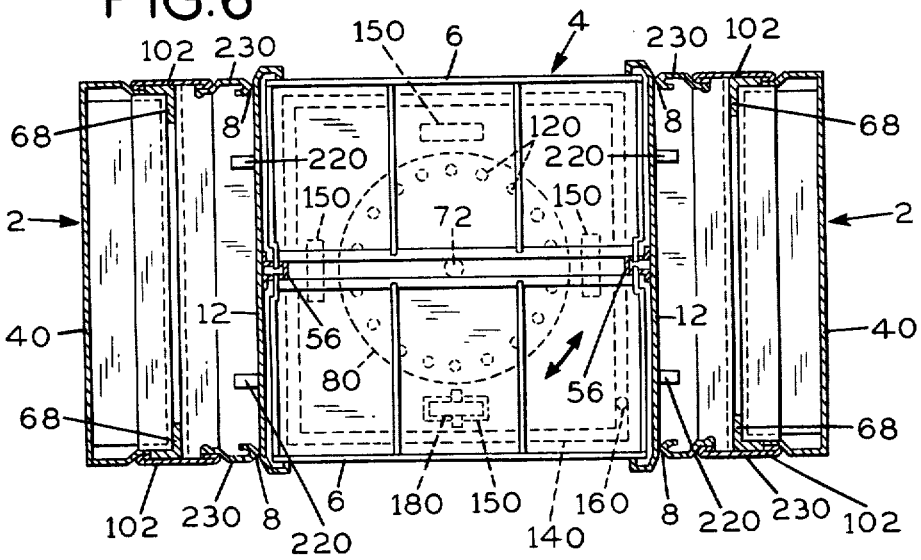
FIG. 6 is a view taken along the line 6—6 of FIG. 3 showing the rotor in open position.

As shown in FIGS. 2 and 3 the rotary storage cabinet of the present invention comprises two subunits: an exterior stationary housing 2 and an internal rotor 4. As seen in FIG. 2 the rotor has been rotated to a position in which the rotary cabinet is closed while in FIG. 3 the rotary cabinet is shown with the rotor having been rotated to present shelves 6 in the front opening 8 of the stationary housing 2. It will be understood that the stationary housing 2 has an opening 8 on the two opposite sides thereof as shown in FIG. 6. The rotor 4 has two sets of shelves 6 opening in opposite directions and presented to the two openings 8 as shown in FIG. 6. As also shown in FIG. 6 the other two sides of the rotor 4 have door or closure panels 12 which in the view of FIG. 6 are moved out of closure position and are within the stationary housing 2. FIGS. 2 and 4 show the rotor 4 rotated to present the door panels 12 at the openings 8 to close the same.

Figure 1:
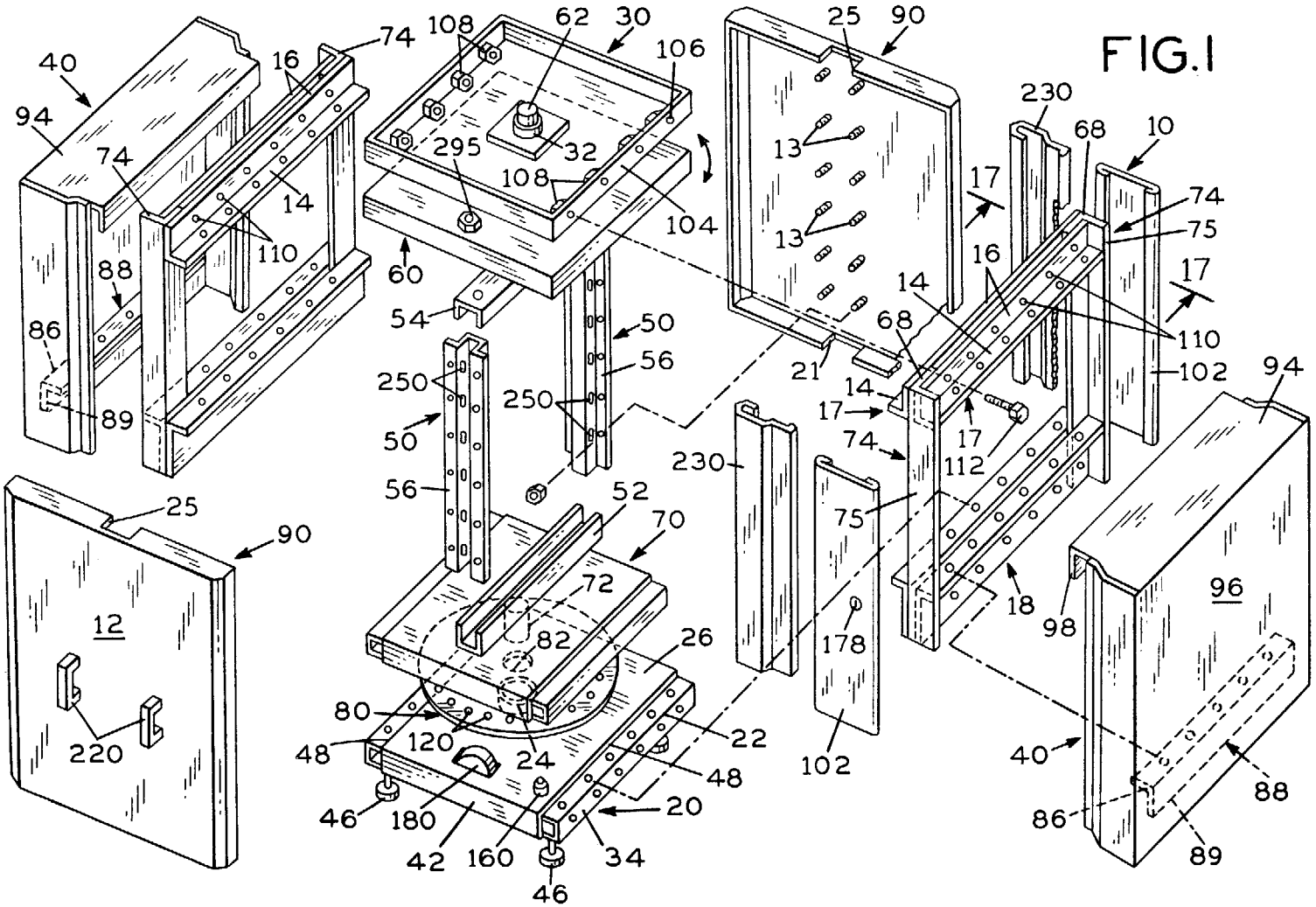
FIG. 1 is an exploded, perspective, somewhat schematic view of a rotary storage cabinet constructed in accordance with the present invention and showing the various sub-assemblies.

FIG. 1 shows an exploded perspective view of one rotary cabinet unit which is made up of the following sub-assemblies:

Stationary housing 2:
- A base 20
- A pair of open rectangular pilaster frames 10
- A top frame pan 30
- A pair of end panels 40

Rotor 4:
- An open rectangular frame 50
- A top frame pan 60
- A bottom swivel pan 70
- A bearing plate 80
- A pair of door or closure panel assemblies 90

The two pilaster frames 10 are identical in construction but in use one is turned 180° about the vertical center line with respect to the other. Similarly, the two end panels are identical and the two door closure panels 90 are identical. As will be seen from FIG. 1 each pilaster frame 10 has two vertical upright angle irons 74 with two horizontal angle irons 18 extending between the bottom ends of the upright angle irons 74 with one angle 18 on each side of the flange 68 of each angle 74. The ends of the flanges 66 of the angle irons 18 are welded to the opposite sides of the flange 68 of each of the upright angle irons 74. Two angle irons 17 extend horizontally between the angle irons 74 adjacent the upper ends of angles 74 with one angle 17 on one side of flanges 68 and the other angle 17 on the other side of flanges 68. The ends of flanges 16 of angles 17 are welded to the opposite sides of the flange 68 of each angle iron 74. Accordingly, the angle irons 17, 18 and 74 comprise an open rectangular welded frame of very considerable strength. It is preferred to also weld face plates 102 to each of the flanges 75 of the angle irons 74.

In assembling the unit the two pilaster frames 10 are mounted on the opposite upper edges 22 of the base 20. At their top the two pilaster frames 10 are connected by the top frame pan 30 which rests on a flange 14 of an angle iron 17 of each of the pilaster frames 10 and it is secured thereto as more fully described hereinafter. It will be seen that the base 20, the two pilaster frames 10 and the top frame pan 30 comprise the basic structural frame of the stationary housing 2 and also serve to support the internal rotor 4. The end panels 40 are mounted to the outside of the pilaster frames 10 as more fully described hereinafter.

Figure 14:
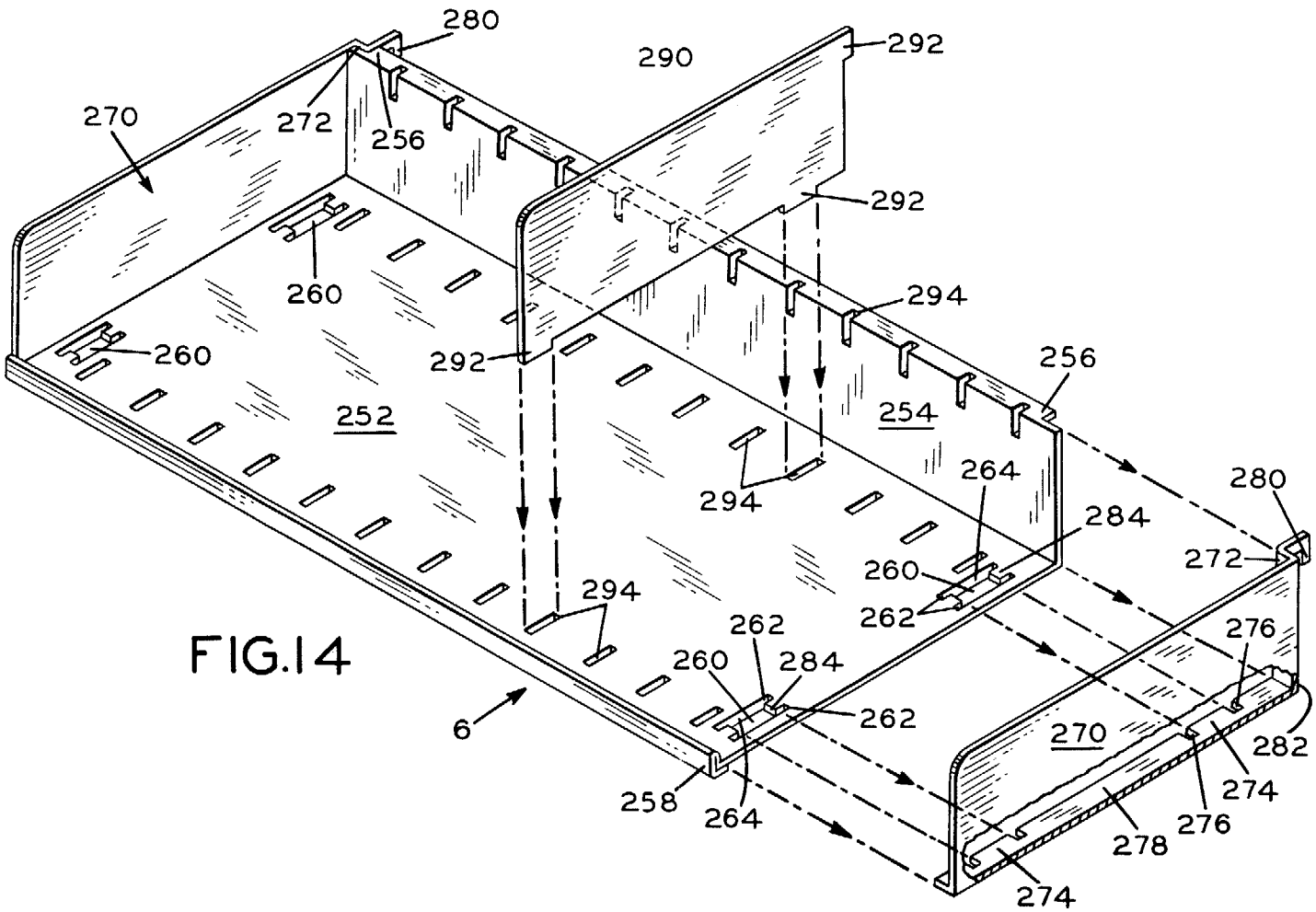
FIG. 14 is an exploded perspective view of a shelf and its two associated end supports.

The rotor frame 50 has two upright channels 56, an upper cross channel 54 and a lower cross channel 52 all welded into an open rectangular frame 50. The rotor 2 also has a swivel pan 70 bolted to the lower U shaped channel member 52 of the rotor frame 50. Similarly, the rotor upper frame pan 60 is bolted to the upper U shaped channel member 54 of the rotor frame 50. The panel assemblies 90 are bolted to the upright channel members 56 of the rotor frame 50. The swivel pan 70 has a downwardly extending post 72 passing through an opening 82 in the bearing plate 80 and then through a suitable bearing 24 in the base 20 as more fully described hereinafter. It will be seen that the bearing plate 80 rests upon the top surface 26 of the base 20 and that the swivel pan 70 bears against the top of the bearing plate 80 thus supporting the entire rotor weight from the base 20. At its top the rotor frame pan 60 has a post 62 extending upwardly into a bearing 32 in the top frame pan 30 in order to stablize the rotor 4 within the housing 2. As shown in FIG. 1 no shelves are provided. Shelves such as shown in FIGS. 3 and 14 or different types of elements extending between the channel uprights 56 of the frame 50 may be provided for housing or supporting whatever articles it is desired to store in the cabinet.

Figures 12, 13:
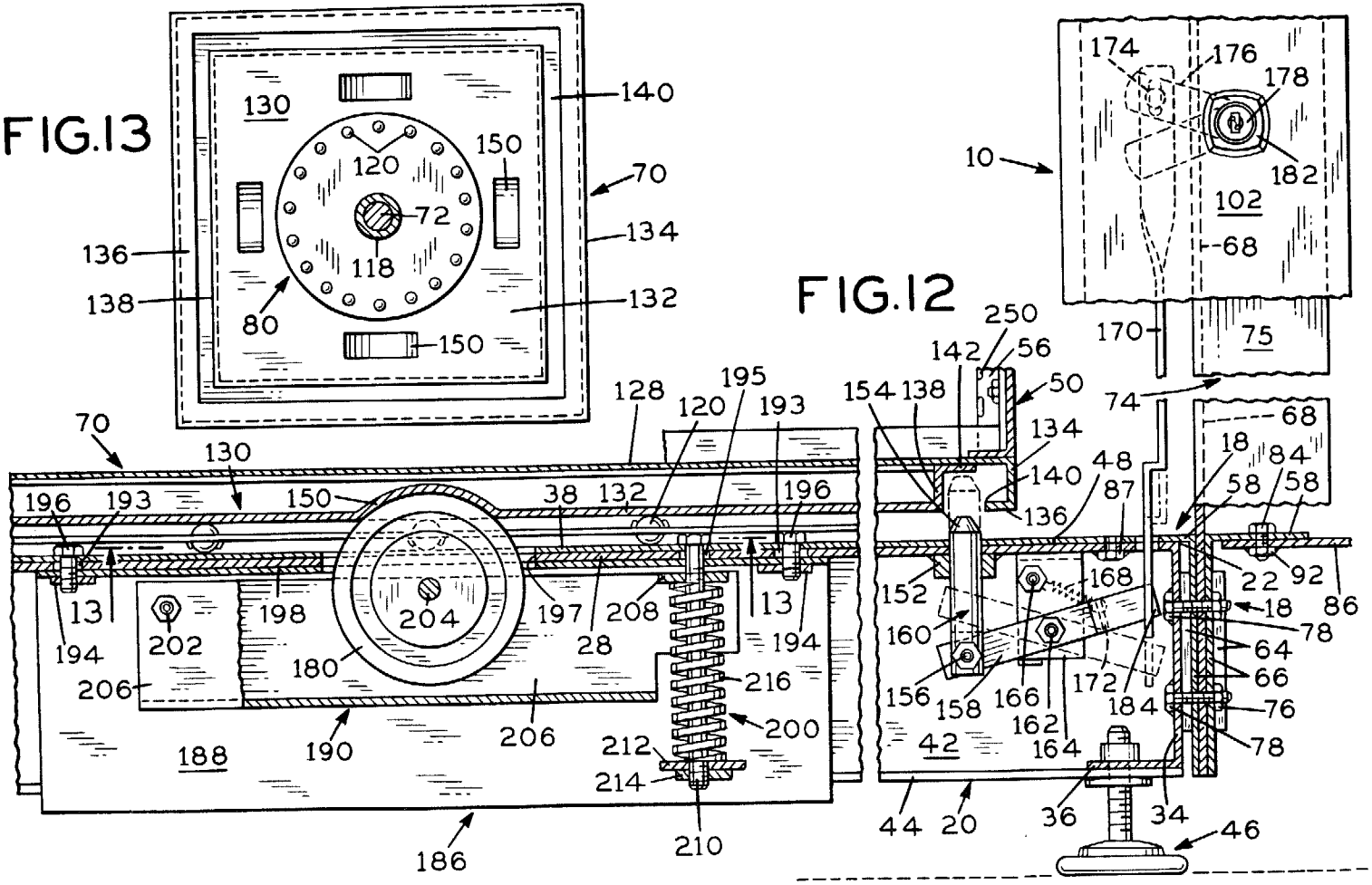
FIG. 12 is a view taken along the line 12—12 of FIG. 11.
FIG. 13 is a view taken along the line 13—13 of FIG. 12.

As shown in FIG. 12 the base 20 is built up from two layers. The bottom layer 28 has its two opposite sides 34 bent downwardly (only one side being shown in FIG. 12). At the bottom the side 34 is bent inwardly to provide a flange 36. The opposite side (not shown) has a correspondingly downwardly and inwardly bent side 34 and flange 36. The top layer 38 of the base 20 has its two opposite sides bent downwardly to provide the depending sides 42 only one of which is shown in FIG. 12. At their bottom the sides 42 are bent inwardly to provide flanges 44. A threaded adjustable foot generally indicated at 46 passes through openings in flanges 36 and is secured thereto in known manner by means of threaded nuts. As will be seen from FIG. 12 the top layer 38 of the base ends at the point or edge indicated at 48 and does not extend all the way to the corner 22 of the base. A flange 58 of an angle iron 18 of the pilaster frame 10 rests on the bottom layer 28 of the base 20 and has its outwardly extending edge abutting the edge 48 of the top layer 38 of the base 20. Short spacer blocks 64 are welded to the flanges 66 of the angle irons 18. When the pilaster frames 10 are assembled as shown in FIGS. 1 and 12 the spacer blocks bear against the end walls 34 of the base 20 and the pilaster frames 10 are held in place by means of bolts 76 passing through suitable openings in flanges 66 and threaded into weld nuts 78 welded to the inside of the end walls 34 of the base 20. It will be appreciated that there are a number of bolts 76 and weld nuts 78 provided along the length of the flanges 66 and wall 34 respectively in order to secure the pilaster frames 10 in place. It will be seen that the pilaster frames 10 rest on the base by virtue of the flanges 58 of the channel member 18 resting upon the lower layer 28 of the base 20 and are secured by the bolts 76 and weld nuts 78. Openings are also provided through the flanges 58 of the channel members 18 through which bolts 84 may be passed as well as through a flange 86 of an angle iron 88 and into a weld nut 92 welded to the opposite side of the flange 86. This angle iron 88 (see FIG. 1) is welded to the inner face of the end panel 40 to secure the same in place after first engaging the top of the end panel assembly 40 in place.

As shown in FIG. 1 the end panel assembly 40 has an upper wall 94 bent at substantially a right angle to the main end panel face 96. At its inner end the end panel 40 has a downwardly turned lip 98 which engages over and behind the upwardly extending flanges 16 on angle irons 17 of pilaster base 10. After engagement of the lip 98 with the upper extending flanges 16 of the angle irons 17 the angle iron 88 is positioned with its flange 86 beneath the flange 58 (see FIG. 12) and bolted thereto by bolt 84. At various points along its length the angle iron 88 is welded to the end panel 40 by spot welding its other flange 89 therealong.

Again having reference to FIG. 1 the pilaster frames 10 are joined together at the top by means of the frame pan 30 which rests on the flange 14 of the angle irons 17 for each of the two frames 10. The frame pan 30 has an upstanding lip or flange 104 extending thereabout. The two opposite sides of the upstanding lip 104 which face the pilaster frames 10 have openings 106 therethrough with weld nuts 108 welded in alignment therewith on the inner side of the lip 104. Holes 110 in the flanges 16 of the angle irons 17 align with the holes 106 and bolts 112 extend through the holes 110 and 106 and are threaded into the weld nuts 108 to secure the frame pan 30 in place in the two pilaster frames 10.

It will be appreciated that while the securement of a pilaster frame 10 to the base 20 has been described for only one of the pilaster frames 10 that the other pilaster frame 10 is secured to the opposite side of the base 20 in exactly the same manner. As mentioned, the pilaster frames 10 are identical and it is only necessary to turn one 180° about its vertical center line in order to mount them in facing position on opposite sides of the base 20. The bolts 76 and weld nuts 78 and the holes associated therewith are so positioned that this interchangeability is possible.

From the above description it will be seen that the base 20, the two pilaster frames 10 and the frame pan 30 comprise the strong basic frame of the cabinet.

Figures 10, 11:
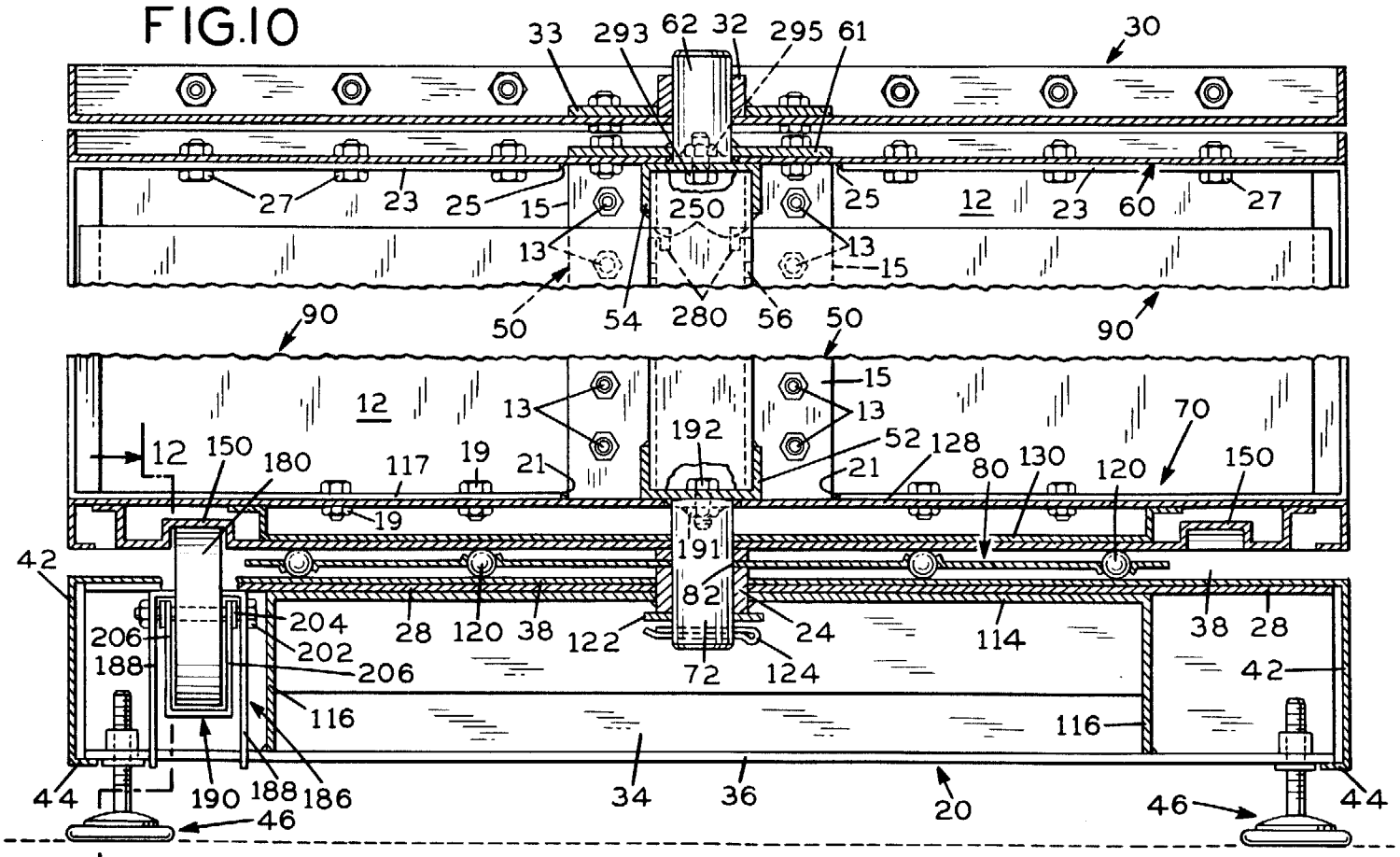
FIG. 10 is a view taken along the line 10—10 of FIG. 3.
FIG. 11 is a view taken along the line 11—11 of FIG. 3.

Reference is now had to FIG. 11 which shows that the base 20 includes not only a bottom layer 28 and a top layer 38 but also includes, welded thereto, a wide U shaped channel member 114 having depending sides 116. This reinforcing member 114 underlies at least all of that area on which the balls 120 of the bearing plate 80 bear. This member 114 serves therefore to greatly strengthen the base 20 and to support the rotor 4 and its contents.

In the center of the U shaped reinforcing member 114, the lower plate 28 and the upper bearing plate 38 of the base 20 there is provided a series of aligned openings in which is positioned a suitable bearing 24. The shaft 72 extends through this bearing 24 and is held in place by means of a washer 122 and a cotter pin 124. The bearing plate 80 has an opening 82 through which the shaft 72 extends as shown and above the bearing plate 80 is provided a spacer member 126. The rotor swivel base 70 has a top floor plate 128 and two reinforcing pans 130, 132 with the reinforcing pan 130 being smaller in the lateral dimensions than the pan 132. The shaft 72 is welded as shown to the floor plate 128 and extends through suitable openings in the pans 130, 132. The lower pan 132 rests upon the top of the balls 120 in the ball bearing plate 80 and on the spacer 126.

As shown in FIGS. 11, 12 and 13 the bottom reinforcing pan 132 has four upstruck detents 150 for reasons hereinafter described. The top layer or floor 128 has a downwardly bent wall 134 around its periphery which terminates in an inwardly extending flange 136. The reinforcing pan 132 has a wall 138 around its periphery terminating in an outwardly extending flange 142 which is welded to the underside of the floor 128. The inwardly turned flange 136 terminates short of the wall 138 thus providing a groove 140 extending entirely around the swivel base 70 at a short distance inwardly of its periphery. This groove 140 is positioned to receive a locking pin 160 whereby the rotor may be locked against rotation in any of its four positions.

The locking pin 160 passes through suitable openings in the lower and upper layers 28 and 38 respectively of the base 20 and also slides in an opening within a bushing 152 secured as by welding to the underside of the lower layer 28 of the base. This bushing 152 is of sufficient vertical extent as to insure that the pin 160 operates in a straight line fashion and does not become cocked. The locking pin 160 has a taper 154 at its upper end to help guide the same into the slot 140. At its opposite end the locking pin 160 is pivoted at 156 to a locking lever 158 which is in turn pivoted at 162 to a support 164 welded to the underside of the lower layer 28 of the base. The support 164 also has a nut and bolt 166 which secures one end of a coil spring 168 to the support 164. The other end of the spring 168 is hooked into an eye 172 secured as by welding to one side of the lever 158 (the side away from the viewer in FIG. 12). Since the eye 172 is on the opposite side of the pivot 162 from the pivot 156 for the locking pin 160 it will be seen that tension in the spring 168 urges the lever 158 in a counter clockwise direction as viewed in FIG. 12 thus maintaining the locking pin 160 in its unlocked position.

A lock rod 170 extends vertically upwardly through suitable openings in the lower and upper layers 28 and 38 of the base and is pivoted at 174 to one end of a lock lever 176 which is secured at its other end (not pivotally) to the barrel of a key lock 178. It will be seen that the lock lever 176 extends through a suitable opening in the flange 68 of one of the vertical angle irons 74 and that the lock 178 extends through openings provided in the flange 75 of the angle iron 74 and through the face plate 102. The lock 178 may be of any conventional design and secured in place by a suitable facing nut 182 threaded to the barrel of the lock 178 in known manner.

Figure 5:
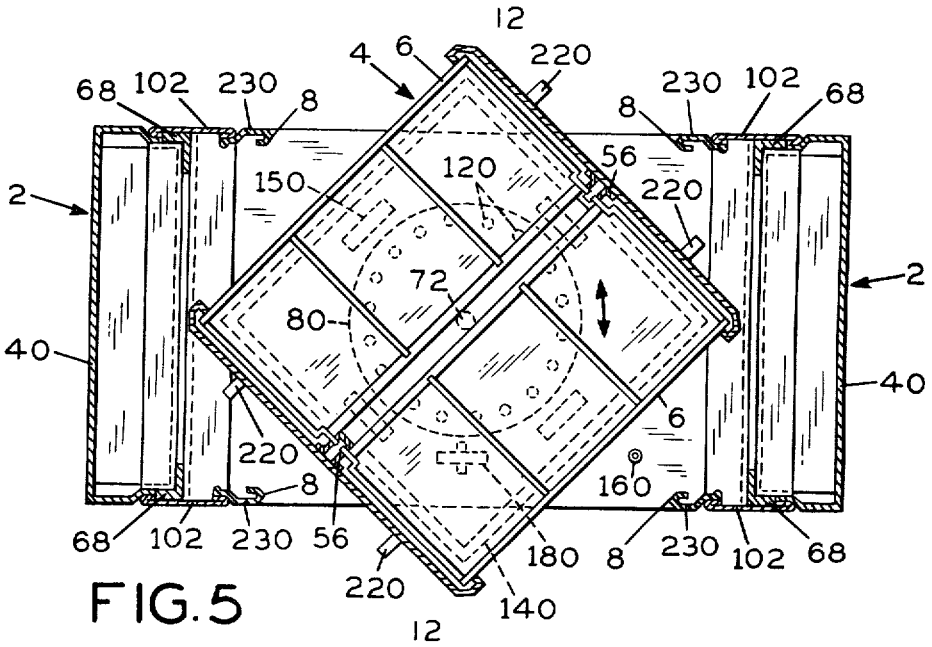
FIG. 5 is a view like FIG. 4 but with the rotor shown during rotation having been rotated approximately 45° from the position shown in FIG. 4.

The lock rod 170 at its lower end is bifurcated having a slot in the center thereof extending inwardly from its lower end. The end 184 of the lock pin lever 158 is positioned in this slot and is held in place against the inner (upper) end of the slot by the spring 168. When it is desired to lock the cabinet the operator merely positions the rotor in any one of the four positions which it can maintain and operates the key to turn the barrel of the lock 178 counter clockwise as viewed in FIG. 12. This moves the lock lever 176 counter clockwise as well and moves the lock rod 170 downwardly to its dashed line position. This movement of the lock rod 170 downwardly rotates the locking pin lever 158 clockwise as viewed in FIG. 12 and urges the locking pin 160 upwardly into its dashed line position in the groove 140 thus locking the cabinet. When the key is later turned in the clockwise direction the locking rod 170 moves upwardly and the spring 168 maintains the end 184 of the lock pin lever 158 in contact with the upper end of the slot in the lock lever 170 effecting a counter clockwise rotation of the locking pin lever 158 and moving the lock pin 160 downwardly out of engagement with the slot 140. Even though the slot 140 extends around the entire swivel base 70 a short distance inwardly of the periphery thereof (see FIG. 13), the same will align with the locking pin 160 in only four positions. At all other positions of the rotor the slot 140 will not be positioned immediately over the locking pin 160. This can perhaps best be seen in FIG. 5 where the locking pin 160 is shown somewhat schematically as is the slot 140. As shown in FIG. 5 the rotor has moved 45° and the slot 140 no longer aligns with the pin 160.

The rotor 4 is securely positioned in any one of its four selectable positions against undesired movement therefrom by means of the four detents 150 in the reinforcing pan 132 which are engaged selectively with a spring urged wheel 180. Mounted to the underside of the lower layer 28 of the base is a downwardly opening channel 186 having two legs 188. The channel 186 has weld nuts 194 which receive bolts 196 passing through suitable elongated slots 193 in the lower and upper layers 28 and 38 respectively of the base 20 and through openings in the bight 198 of the U shaped channel 186 which openings are aligned both with the weld nuts 194 and the slots 193. Within the channel 186 is another smaller upwardly opening U shaped channel 190 which is mounted by means of a nut and bolt 202 in pivoted fashion within the outer channel 186. The wheel 180 is mounted for ready rotation upon an axle 204 which extends entirely through the wheel 180 and through the lateral upstanding walls 206 of the channel 190. The wheel 180 extends upwardly through elongated aligned slots 197 in the layers 38 and 28 and in the bight 198 of channel 186. The wheel 180 extends sufficiently through slot 197 to permit it to bear against the under surface of pan 132.

It will be seen that the channel 190 is pivoted at one end, the wheel 180 is mounted intermediate the length of the channel 190 and that at the end opposite to the pivot the channel 190 carries a spring mechanism 200. Welded transversely across and between the upstanding walls 206 of the channel 190 is a plate 208. Extending downwardly loosely through a suitably large slot 195 in the lower and upper layers 28 and 38 of the base 20 and also in the bight 198 of the channel 186 is a bolt 210. These aligned slots are small enough to retain the bolt being smaller than the head thereof but are larger than the shank in order to permit a loose fit for rotation of the bolt 210. Adjacent the lower end of the bolt 210 it passes through another plate 212 to which is welded a weld nut 214 into which the bolt 210 is threaded. The plate 212 extends between the parallel legs 188 of the channel 186 but is not secured thereto. The ends of the plate 212 are cut square and merely slidingly engage the inner surfaces of the depending legs 188. Accordingly, upon rotation of the bolt 210 in a tightening direction its threads interact with the nut threads for the nut 214 to move the plate 212 upwardly which action further compresses a spring 216 positioned between the plates 208 and 212. This casues the spring to bear with greater pressure on the plate 208 urging it with greater pressure counter clockwise about the pivot 202 along with the entire channel 190. This causes the wheel 180 to bear with increased pressure against the undersurface of the reinforcing pan 132. To reduce the pressure of the wheel 180 against the undersurface of the reinforcing pan 132 the head of the bolt 10 is simply rotated in the opposite (loosening) direction. The head of the bolt 210 may be reached with an open end wrench from outside of the cabinet simply by inserting it between the reinforcing pan 132 and the base 20 from outside the cabinet. Alternatively, the bolt 210 may be positioned such that it is exposed during a portion of the rotation of the rotor 4 in the same manner as the pin 160.

The slots 193, 195 and 197 are elongated (from left to right in FIG. 12) in order to permit adjustment of the wheel 180 to the left and right within its slot 197. This adjustment is effected by loosening bolts 196 and sliding the channel 186 (and thus the entire wheel sub-assembly) in the desired direction. By this adjustment the point along the slot 197 at which the wheel 180 engages the detents 150 may be adjusted. This insures that the rotor 4 stops with the sides of its swivel base 70 perfectly parallel to the sides of base 20.

When the lock pin 160 is in its unlocked position the rotor may be turned from its position as shown in FIG. 2 to its position as is shown in FIG. 3 simply by pushing on the door closure panel 12 or gripping one of the handles 220 provided for the purpose on each of the door panels 12. Initially enough force must be applied not only to overcome the inertia of the rotor and its contents but also to overcome the friction applied by the wheel 180 to the reinforcing pan 132 and, in particular, enough force must be applied to pivot the channel 206 downwardly against the compression forces in spring 216 in order that the wheel 180 may roll out of the detent 150. Thereafter only enough force is required to keep the rotor turning and the wheel 180 will rotate about its axis 204 due to its engagement with the underside of the reinforcing pan 132. When the next position, 90° removed from the first, is reached the spring 216 will move the channel 190 upwardly about the pin 202 engaging the wheel 180 in the next detent 150. The engagement of the wheel 180 in the detent 150 is sufficient to keep the rotor from inadvertant rotation under normal conditions and if it is not, additional tension may be applied to the spring 216 by adjusting the bolt 210. It will be appreciated that since the wheel 180 is positioned generally tangent to a circle drawn about the axis 230 of the rotor and through the detents 150 there will be a very slight scrubbing action between the outer surface of the wheel 180 and the undersurface of the reinforcing pan 132. This scrubbing action can be greatly minimized by slightly crowning the outer surface of the wheel 180 rather than providing the flat surface shown. In fact, the scrubbing action is generally quite slight and what small resistance this provides is desirable in preventing the rotor from rotating too fast.

Figure 7:
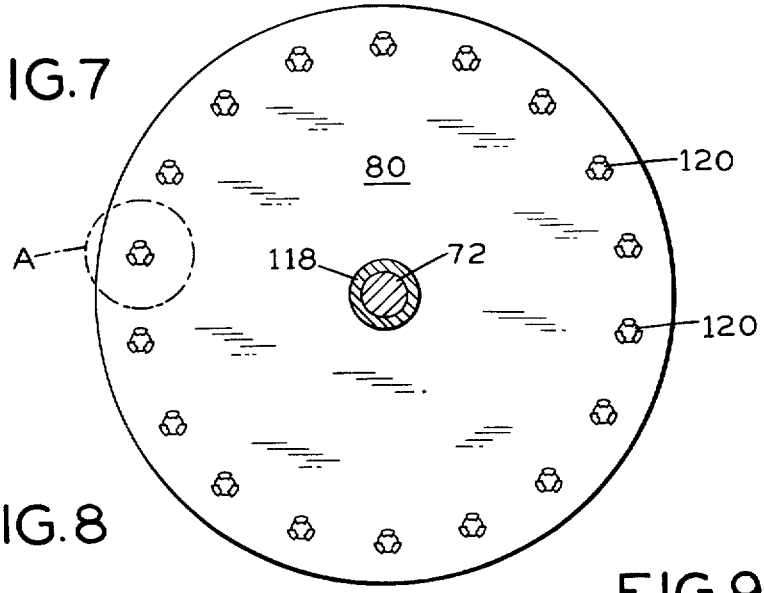
FIG. 7 is a view of the bearing plate upon which the rotor rests.
Figure 8:
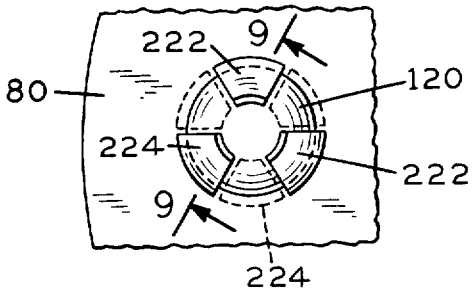
FIG. 8 is an enlarged view of the portion marked A in FIG. 7.
Figure 9:
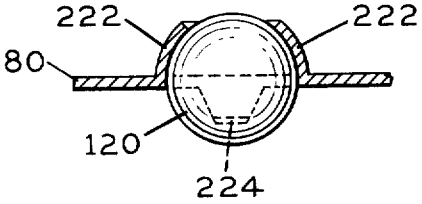
FIG. 9 is a cross-sectional taken along the line 9—9 of FIG. 8.

Shown in FIGS. 7, 8 and 9 is the construction of the ball bearing plate 80. A plurality of ball bearings 120 are arranged in circular openings in the plate 80 and retained therein by integral tabs 222 struck upwardly from the plate 80 and tabs 224 struck downwardly therefrom. The tabs 222 and 224 alternate with each other and are curved as shown in FIG. 9 to engage the outer spherical surface of the ball 120 and retain the same in position. These tabs 222, 224 extend over the surface of the balls 120 only a sufficient amount to retain them in place leaving a portion thereof exposed to bear against the base 20 and to support the pan 132 of the swivel base 70.

FIGS. 10 and 11 show the mounting arrangement for the top and bottom respectively of the rotor 50. The central frame of the rotor (see FIG. 1) comprises a pair of identical vertical uprights 56 welded at their upper ends to a downwardly opening U shaped channel 54 and at their bottom ends to an upwardly opening channel member 52. This central frame 50 is bolted by means of bolts 192 passing through the channel 52 to the swivel base 70, and more particularly the bolts pass through the upper floor 128 thereof and are threaded into nuts 191 welded to the underside thereof. The swivel base 70 is rectangular, preferably square, and the frame 50 is bolted across the square swivel base 70 at the center thereof.

At its top the frame 50 is positioned crosswise through the middle of an upwardly opening frame pan 60 by means of bolts 193 passing through the upper channel member 54 and into weld nuts 195 positioned on the floor inside of the pan 60.

Bolted to the upper surface of the floor of the frame pan 60 is a reinforcing shaft plate 61 to which is welded an upper shaft 62. The upper shaft 62 passes through a bearing 32 welded to a bearing plate 33 mounted by means of bolts to the upper surface of the frame pan 30. In FIG. 10 the rest of the stationary frame, other than the upper frame pan 30 and the base 20, is deleted in the interest of clarity. As mentioned above, the frame pan 30 and the base 20 interconnect the two pilaster frames 10.

The mounting of the door or closure panels 90 is also shown in FIGS. 10 and 11. This sub-assembly 90 has a facing panel 12, the inside of which is seen in FIGS. 10 and 11. Welded to the facing panel 12 are two rows of threaded studs 13 which pass through openings in the laterally extending flanges 15 of the upright channel member 56. Nuts are then applied to the inside of the studs 13 to secure the panels 12 in place. At their bottom the panels 12 have inwardly bent flanges 117 which rest upon the floor 128 of the swivel base 70 and are secured thereto by bolts 19. The flanges 117 on each door are relieved or notched as indicated at 21 in order that the notch may accept the vertical upright 56 of the frame 50. Similarly, at the top the door panels 12 have inwardly projecting flanges 23 bolted at 27 to the bottom of the rotor frame pan 60. A notch 25 is provided in each flange 23 to accept the upright 56. It will be apparent therefore that each of the closure sub-assemblies 90 is secured across the top and bottom and down the center in a generally "I" fashion.

Figure 15:
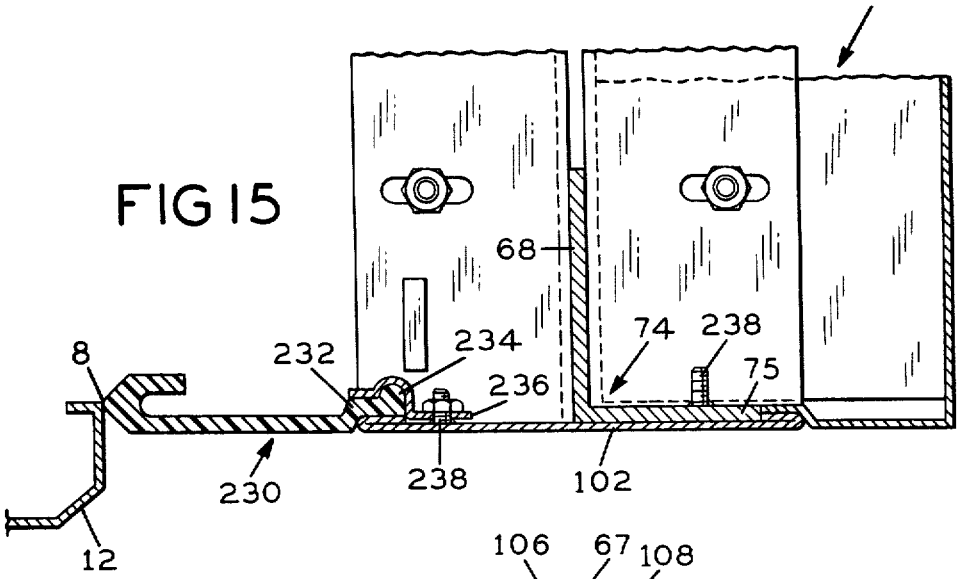
FIG. 15 is an enlarged detailed view taken along the line 15—15 of FIG. 2.

As will be apparent from FIGS. 4 and 5 there is provided a flexible strip 230 on the vertical lateral edges of both openings 8 of the stationary housing 2. These flexible members 230 may be of rubber, plastic or the like and not only provide for the rotation of the generally square shaped rotor 4, but, most importantly, guard against the pinching of fingers if one tends to push ones hand along with the surface of the rotor into the space within the housing 2. These flexible members 230 are mounted along the vertical edge of the face plates 102 which define the lateral edges of the openings 8 in the housing 2. The shape and mounting of these flexible strips 230 is best shown in FIG. 15 as including an offset portion 232 disposed behind the face plate 102 and having a curved ridge 234 along one margin thereof. A suitably shaped clamp 236 is bolted to the inside of the face plate 102 along its entire vertical extent by means of studs 238 the heads of which are welded to the interior of the face plate 102. There may be a clamp 236 for each stud 238 or, preferably, one long clamp 236 of the same vertical extent as the flexible strip member 230 with a plurality of opengings therethrough to receive the row of studs 238. A second row of studs 238 (only one of which is shown) is located to the right in FIG. 15 and are welded to the inner surface of flange 75 of the vertical angle iron 74. This second row of studs 238 will be used when it is desired to add a second cabinet to the right of an existing cabinet as shown in FIG. 15.

When adding additional rotary storage cabinets, the end panel assembly 40 on one side is removed by removing the bolts 84 (see FIG. 12) which secure the flange 86 of the angle iron 88 to the flange 58 of the angle iron 18 of the pilaster frame 10. While an additional or "add-on" unit may be added either on the right or the left as viewed in FIG. 12, the following description is directed to adding the additional unit on the right. To add a unit on the left the same procedure is used though the parts are arranged as a mirror image of those shown in the figures. After removal of the bolts 84 the bottom of the panel assembly 40 may be pulled outwardly and then the assembly lifted to disengage the flange 98 from its engagement with the upper edge of the flange 16 of angle iron 17. The end panel assembly 40 is then set aside.

Figure 17:
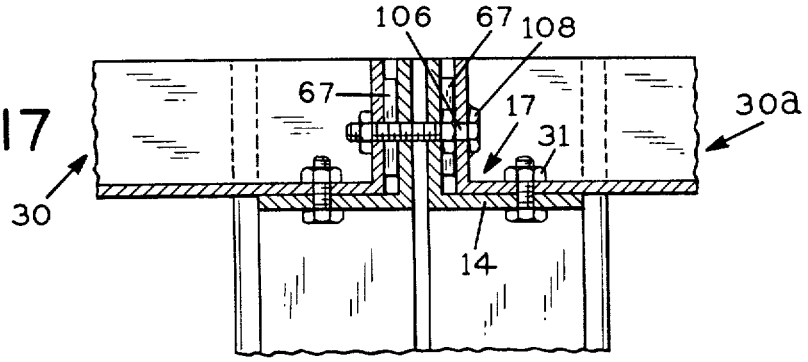
FIG. 17 is an enlarged detailed view taken generally along the line 17—17 of FIG. 1 showing the manner in which the top frame pan for the housing is secured and also showing the securing of an additional top frame pan for an additional unit.
Figure 16:
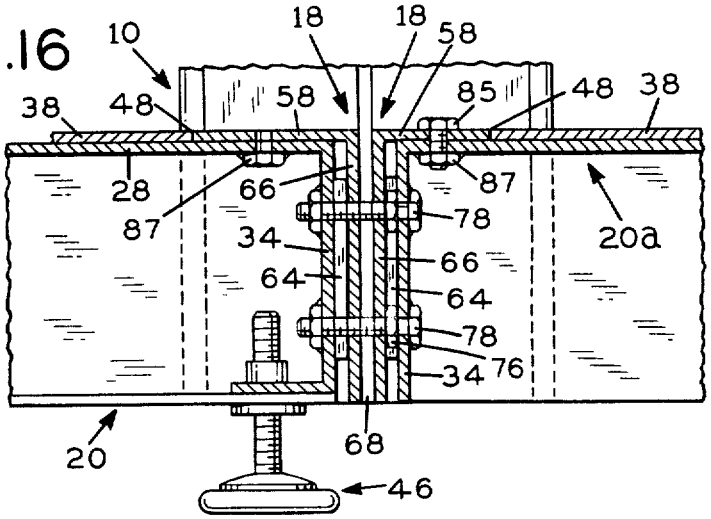
FIG. 16 is a view of a portion of FIG. 12 showing how an additional base for an additional unit may be secured to an existing unit.

A second "add-on" rotary file cabinet may be added as indicated in FIGS. 16 and 17. The new base 20*a* is first bolted to the existing cabinet as shown in FIG. 16. The base 20*a* is slid under the right hand flange 58 of the pilaster frame 10 in place of the flange 86 of the angle iron 88 on the end panel assembly 40 which has just been removed. The right hand flange 58 therefore rests upon the bottom layer 28 of the top of the base 20*a*. The base 20*a* is slid into the pilaster frame 10 until the edge 48 of the upper layer 38 of the base 20*a* abuts the edge of the flange 58. A bolt 85 is then passed through the opening provided in flange 58 and into weld nut 87 welded to the underside of the lower layer 28 of the base 20*a*. The reason for the spacers 64 now becomes apparent. The spacer 64 welded on the flange 66 of the left hand angle iron 18 bears against the wall 34 of the left hand base 20 and serves to space the base 20 a distance from the flange 66 equal to the thickness of a bolt head. The spacer 64 to the right which is welded to the right hand flange 66 as viewed in the figure is also of the thickness of a bolt head such as bolt head 76 for the securement of the left hand base 20. The spacers 64 provide an area greater than that of a bolt head for the base to bear against. Thus it will be seen that the adjacent walls 34 of the bases 20 and 20*a* are spaced the same distance from the central vertical flange 68 of the angle irons 74. The weld nuts 78 on the inside of wall 34 for the base 20*a* are not used though shown in FIG. 12.

Having secured the new base 20*a* at the bottom a new upper frame pan 20*a* is secured at the top to the lower flange 14 of the angle iron 17 that is to the right in FIG. 17 by means of a bolt and nut arrangement 31. The spacers 67 at the top serve the same purpose for the frame pans 30, 30*a* as do the spacers 64 at the bottom for the bases 20, 20*a*.

The assembly of the "add-on" unit then continues in the same manner as construction of the original unit. A pilaster frame 10 (not shown) identical to those shown is secured to the right hand end of the base 20*a* and frame pan 30*a*. This assembly is identical to that shown for the right hand end of pan 30 and base 20 in FIGS. 17 and 16 respectively. A second rotor 4 identical to that shown is also supplied and the end panel 40 which previously occupied the position shown in FIG. 12 is now relocated on the additional third pilaster frame 10 to the right of the second unit (not shown). As mentioned above, an additional flexible strip 230 and clip 236 are supplied to the right hand row of bolts 238 as viewed in FIG. 15 in place of the former end panel 40 with a flexible strip 230 being provided at each of the lateral edges of the two opposite openings 8 in the new "add-on" unit. It will be seen therefore that the "add-on" unit requires one less pilaster frame 10 and two fewer (no) end panel assemblies 40. Thus the cost of these three sub-assemblies may be eliminated from the second and subsequent units added. It will be appreciated that the second unit added shares a pilaster frame 10 with the original unit and such is true of each subsequent unit added.

As thus far described, the rotary storage cabinet of this invention is completely open and the same may be used as such for the storage of large objects; however, the storage cabinet is adaptable to a number of storage applications including, among others, file storage; magnetic tape storage as reels, casettes, discs and the like; clothing storage; and numerous other applications. In order to adapt the storage cabinet to various uses a plurality of vertical slots 250 are provided on either side of the vertical channel frame members 56 of the frame 50 of the rotor 4. These openings 250 are vertically elongated slots and there are a considerable number of them on either side of the members 56. One common use of the cabinet will be as a filling cabinet and for this purpose reference has been made to the shelves 6 in FIG. 3. The details of the shelves 6 are shown in FIG. 14. Each of the shelves 6 comprises a horizontal platform 252 with a vertical back 254 integral with the material of 252 and bent at a right angle with respect thereto. The vertical back 254 has a lip 256 bent at a right angle with respect thereto. Toward the front the platform 252 has a lip 258 integral therewith and formed by bending the edge upwardly a short distance and then back upon itself as clearly shown in FIG. 14. Adjacent its corners the platform 252 has four recesses 260 each of which comprise two parallel cut-outs 262 and a central depressed portion 264.

To support the shelves 6 there are two end panels 270 which are mirror images of each other. At their upper inner corners the end supports 270 have offsets 272 bent towards the center of the shelf. Extending at a right angle from these offsets are hooks 280 which engage in the slots 250 in the frame uprights 56. As best shown in FIGS. 10 and 11 these hooks are of such a dimension as to pass through the slots 250 and then drop down and engage the lower edges of the slots. Once engaged there is a very slight pivoting action of the shelf with respect to the bottom edges of the slots 250 and the lower corners 282 of the shelf supports come to rest against the adjacent surface of the uprights 56.

The end supports 270 also include an inwardly bent flange 278 having four notches 276 therein which define two tabs 274. The two tabs 274 and the flange 278 are all in the same plane and are inserted under the floor 252 of the shelf 6. During this insertion the tabs 274 enter the recesses 260 above the material 264 of the depressions therein. During this insertion the slots 276 receive the vertically sloped portions 284 of the depressions. It will be appreciated that the shelf is first assembled with its end supports and then installed as a unit by passing the hooks 280 through the openings 250 in the uprights 56. Any number of dividers 290 may be provided having outwardly extending tabs 292 for insertion in slots 294 in the shelf 6.

I claim:

1. In a rotary storage cabinet having a stationary housing with openings in two opposite sides and a rotor mounted for rotation in said housing and wherein said rotor has four sides with two opposite sides positionable to present the contents of the cabinet to the openings in said housing and said rotor also having two other opposite sides positionable to close the openings in said housing, the improvement comprising said housing having a base, said rotor having a rectangular base with an upper and an under surface, said rotor base being supported for rotation relative to said housing base, a groove in said under surface spaced inwardly from the periphery of the rotor base and extending substantially completely around said under surface, a lock pin mounted in the housing base for vertical reciprocating motion to and from a first and second position, said lock pin when in said first position engaging said groove to prevent rotation of said rotor, said lock pin in said second position being retracted from engagement with said rotor base whereby rotation of said rotor is permitted, lock means actuatable to effect movement of said lock pin to and from said positions, and said groove defining a rectangle in said under surface whereby said groove aligns with said lock pin in four positions of said rotor.

2. The cabinet of claim 1 in which said housing base has an opening therethrough, said lock pin extends through said opening and into said groove when said groove is aligned with said opening and said lock pin is in said first position.

* * * * *